US012746480B2

(12) United States Patent
Hunter et al.

(10) Patent No.: US 12,746,480 B2
(45) Date of Patent: Sep. 29, 2026

(54) WATER RIDE WITH FLOATING SECTION

(71) Applicant: PROSLIDE TECHNOLOGY INC., Ottawa (CA)

(72) Inventors: Richard Douglas Hunter, Ottawa (CA); Raymond Thomas Smegal, Ottawa (CA)

(73) Assignee: PROSLIDE TECHNOLOGY INC., Ottawa (CA)

( * ) Notice: Subject to any disclaimer, the term of this patent is extended or adjusted under 35 U.S.C. 154(b) by 648 days.

(21) Appl. No.: 18/003,052

(22) PCT Filed: Jun. 25, 2021

(86) PCT No.: PCT/CA2021/050883
§ 371 (c)(1),
(2) Date: Dec. 22, 2022

(87) PCT Pub. No.: WO2021/258222
PCT Pub. Date: Dec. 30, 2021

(65) Prior Publication Data

US 2023/0277949 A1 Sep. 7, 2023

Related U.S. Application Data

(60) Provisional application No. 63/044,061, filed on Jun. 25, 2020.

(51) Int. Cl.
*A63G 21/18* (2006.01)

(52) U.S. Cl.
CPC ..... *A63G 21/18* (2013.01)

(58) Field of Classification Search
CPC ..... A63G 21/18
(Continued)

(56) References Cited

U.S. PATENT DOCUMENTS 1,274,824 A * 8/1918 Wallace ..... A63G 21/00 182/49
2,174,716 A * 10/1939 Bethell ..... A63C 19/10 404/35

(Continued)

FOREIGN PATENT DOCUMENTS

EP 1604712 A1 12/2005

OTHER PUBLICATIONS

Notification of the substantive examination report, issued by Saudi Authority for Intellectual Property in Saudi Arabian Patent Application No. 522441893.

(Continued)

*Primary Examiner* — Joseph A Dillon, Jr.
(74) *Attorney, Agent, or Firm* — Finnegan, Henderson, Farabow, Garrett & Dunner, LLP

(57) ABSTRACT

A water ride is disclosed. The water ride has a flume adapted to have riders or ride vehicles travel from an initial location at a first elevation to a terminal location at a second elevation lower than the first elevation. The flume includes at least one sliding section wherein the riders or ride vehicles slide on a sliding surface of the flume and at least one floating section wherein the riders or ride vehicles float in the flume. The floating section is fluidly connected to the first sliding section and includes a plurality of flow-altering elements attached to and protruding from the flume.

27 Claims, 15 Drawing Sheets

(58) Field of Classification Search
USPC ..... 472/117
See application file for complete search history.

(56) References Cited

U.S. PATENT DOCUMENTS

| | | | | |
|---|---|---|---|---|
| 3,429,067 | A * | 2/1969 | Warren | A63H 33/00 273/127 R |
| 4,836,521 | A * | 6/1989 | Barber | A63G 3/02 472/117 |
| 5,421,782 | A | 6/1995 | Lochtefeld | |
| 5,453,054 | A | 9/1995 | Langford | |
| 6,006,672 | A | 12/1999 | Newfarmer et al. | |
| 6,019,547 | A * | 2/2000 | Hill | A63G 31/007 4/491 |
| 6,336,771 | B1 * | 1/2002 | Hill | A63G 31/007 4/491 |
| 6,527,646 | B1 | 3/2003 | Briggs | |
| 6,634,953 | B1 * | 10/2003 | Czintos | E01C 13/107 472/117 |
| 6,932,541 | B2 * | 8/2005 | McFarland | E04H 4/0006 472/117 |
| 7,066,821 | B2 | 6/2006 | Langford | |
| 7,285,053 | B2 | 10/2007 | Henry et al. | |
| 10,398,991 | B2 | 9/2019 | Vance et al. | |
| D1,024,249 | S * | 4/2024 | Hunter | D21/821 |
| 11,964,213 | B2 * | 4/2024 | Braun | A63G 31/007 |
| 12,076,656 | B2 * | 9/2024 | Braun | A63G 21/10 |
| 2010/0160054 | A1 | 6/2010 | Henry | |
| 2019/0143226 | A1 * | 5/2019 | Briggs | A63G 21/18 472/117 |
| 2023/0415049 | A1 * | 12/2023 | Frankowski | A63G 21/18 |

OTHER PUBLICATIONS

International Search Report, PCT/CA2021/050883, dated Sep. 9, 2021.

Extended European Search Report in corresponding European Patent Application No. 21828338.0 dated Jun. 24, 2024 (9 pages).

Notification of the Substantive Examination Report in corresponding Saudi Arabian Patent Application No. 522441893 dated Jul. 7, 2024 (14 pages, translation included).

Search Report and Office Action in corresponding United Arab Emirates Patent Application No. P6002777/2022, issued Dec. 11, 2024 (12 pages).

* cited by examiner

WATER RIDE WITH FLOATING SECTION

FIELD

This application relates generally to water rides and, more specifically, to water rides having a floating section.

BACKGROUND

Some conventional water rides are configured as water slides where riders slide through the ride from a starting location at a higher elevation to a terminal location at a lower elevation, either without a vehicle or with a vehicle, such as a mat, boat, tube or raft, alone or with other riders. To facilitate sliding, portions of the water slide may be lubricated with a volume of water.

In yet other conventional water-based amusement rides, riders float rather than slide through the ride. Typically, in such rides, riders will be in a vehicle conducive for floating, such as a tube or raft, but may also be wearing personal flotation devices. The starting and terminal locations of such rides are typically at substantially the same elevation or the ride may even be configured as a continuous loop where riders exit and enter the slide at a large pool through which the riders travel as part of the ride. One set of such known water rides is referred to as "river" style rides where riders typically occupy a tube or raft and float through an endless floating channel at relatively low speeds. Such river style rides are typically made of a concrete or stone channel and do not provide the same level of thrill as provided by a water slide-style ride.

SUMMARY

In one aspect of the present disclosure, there is provided a water ride comprising a flume adapted to have riders or ride vehicles travel from an initial location at a first elevation to a terminal location at a second elevation lower than the first elevation, the flume comprising: at least one sliding section wherein the riders or ride vehicles slide on a sliding surface of the flume; and at least one floating section wherein the riders or ride vehicles float in the flume, the floating section being fluidly connected to the first sliding section and comprising a plurality of flow-altering elements attached to and protruding from the flume.

In another aspect of the present disclosure, there is provided a flume section for a water ride, the flume section comprising: an inlet to permit riders or ride vehicles to enter the flume section; an outlet to permit riders or ride vehicles to exit the flume section; and a plurality of flow-altering elements operable within the flume section, wherein, in operation, the flume section provides a flowing body of water for the riders or ride vehicles to float in.

In another aspect of the present disclosure, there is provided a water ride comprising a flume adapted to have riders or ride vehicles travel from an initial location at a first elevation to a terminal location at a second elevation lower than the first elevation, the flume comprising: a first sliding section wherein the riders or ride vehicles slide on a sliding surface of the flume; a floating section wherein the riders or ride vehicles float in the flume, the floating section immediately following the first sliding section and being fluidly connected to the first sliding section; and a second sliding section wherein the riders or ride vehicles slide on a sliding surface of the flume, the second sliding section immediately following the floating section and being fluidly connected to the floating section, wherein a first transition from the first sliding section to the floating section is discontinuous, wherein a second transition from the floating section to the second sliding section is continuous, and wherein water is injected into the floating section and removed from the floating section to maintain a desired body of water in the floating section.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION

Figure 1A:
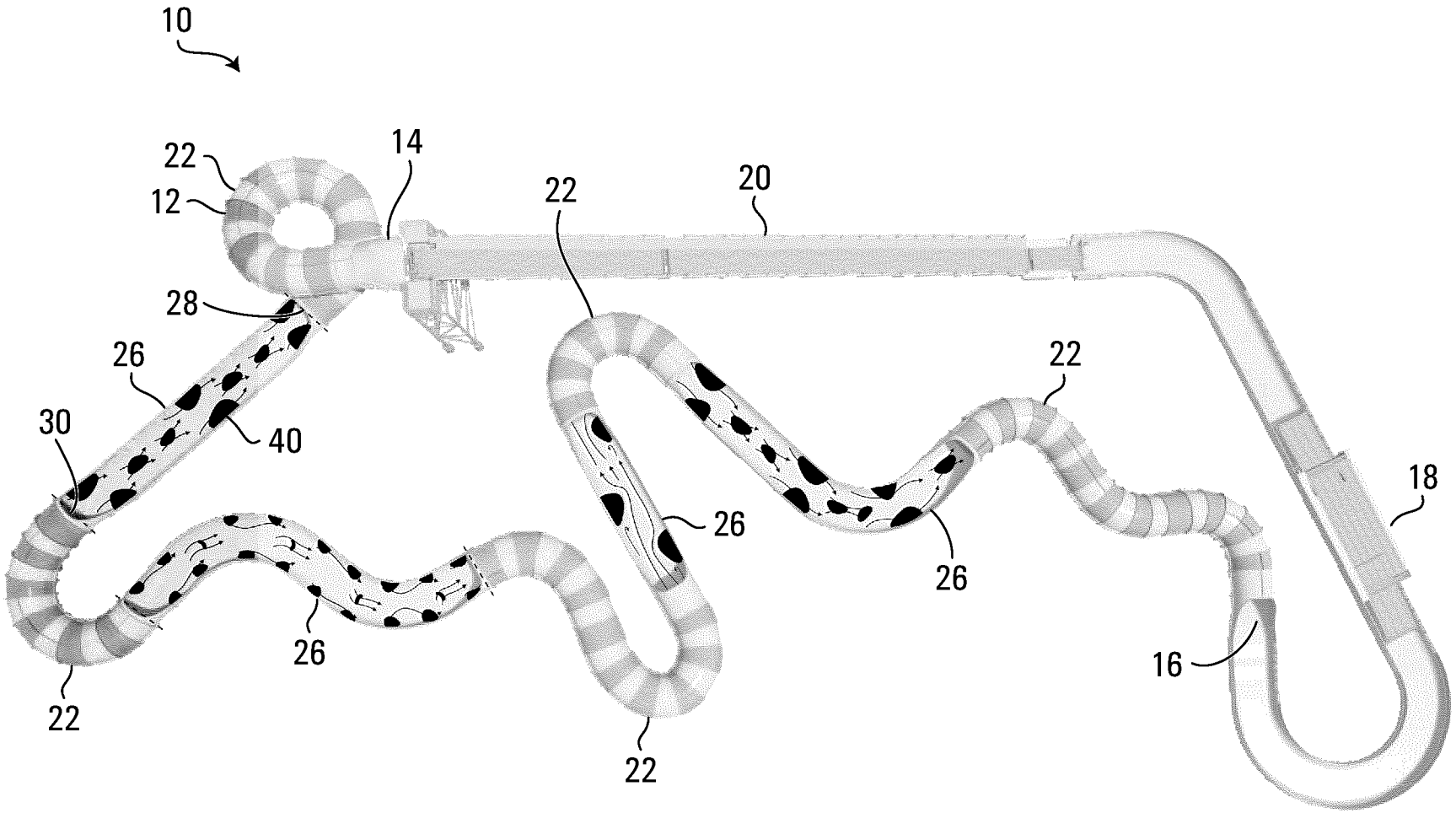
FIG. 1A is a schematic plan view of a water ride according to one embodiment of the present disclosure.

Referring to FIGS. 1 to 5, embodiments of a water ride 10 according to the present disclosure will be described. The water ride includes a flume 12 adapted to have ride vehicles 13 travel from an initial location 14 at a first elevation to a terminal location 16 at a second elevation lower than the first elevation. In the illustrated embodiment, a loading and unloading station 18 is included where riders who have just completed the ride may exit and a new set of riders may enter the vehicles 13. The vehicles 13 are then raised to the initial location 14 using sloped conveyor 20.

The flume 12 includes multiple sections which are fluidly connected so that riders travel a continuous path from the initial location 14 to the terminal location 16. The flume 12 includes at least one sliding section 22 where the ride vehicles 13 slide on a sliding surface 42 of the flume 12. The sliding surface is lubricated with a flow of water that flows from the initial location 14 to the terminal location 16.

The flume 12 further includes at least one floating section 26 where the ride vehicles 13 float in the flume 12. Each floating section 26 includes an inlet 28 and an outlet 30. In operation, the inlet 28 and outlet 30 cooperate to create a steady-state body of water 31 within the floating section 26 that is deep enough for the ride vehicles 13 to float in. Thus, while water flows into the floating section 26 from the first sliding section 22 and out of the floating section 26 into the next sliding section 22, the riders experience floatation between the inlet 28 and outlet 30 of each respective floating section 26.

The floating section 26 described herein may be included in a wide variety of ride configurations. The floating section 26 could come before or after the sliding section 22. It may have several sliding sections 22 splitting off of it, either fluidly connected or via a platform or other intermediate structure. A ride configuration, as shown in FIG. 1A, may have several sliding sections and floating sections alternating back and forth. Moreover, a ride incorporating a floating section as described here may incorporate one or more other ride features such as bowls, walls, funnels, saucers, or propulsion sections, either before, after, and in any combination with the floating section.

Figure 1B:
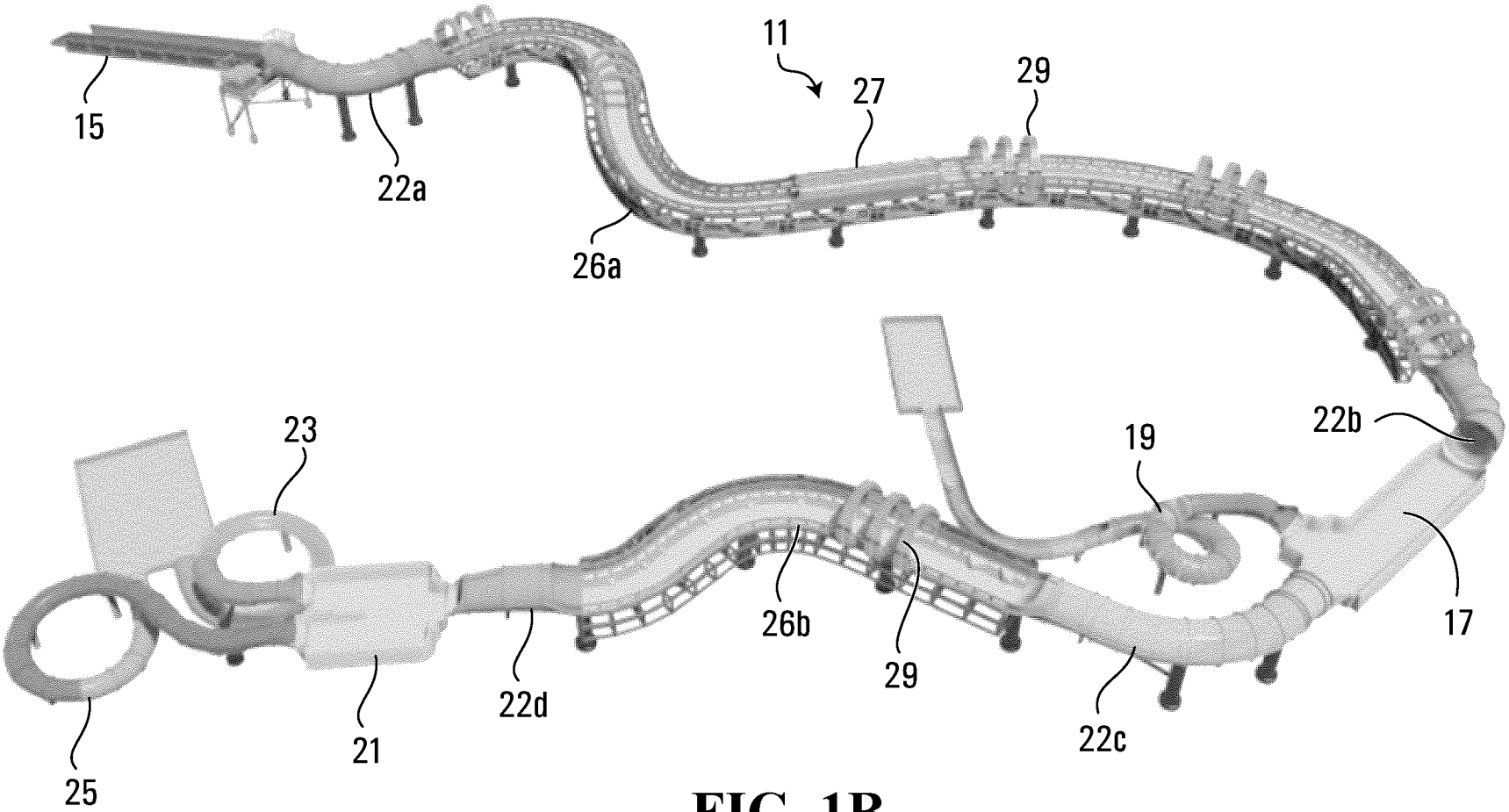
FIG. 1B is a schematic view of a water ride complex according to one embodiment of the present disclosure.

FIG. 1B shows another schematic of a possible ride configuration that incorporates multiple sliding sections 22 and floating section 26 interconnected into a ride complex 11. The complex 11 includes a ride-up conveyor 15 leading to the start of a first sliding section 22*a*, followed by a first floating section 26*a*, which in turn leads to a second sliding section 22*b*. The second sliding section 22*b* leads to an intermediate transition 17 that, in the illustrated embodiment, is configured as a pool in which riders may choose to continue onto the third sliding section 22*c* or exit the complex 11 via intermediate sliding water ride 19. A second floating section 26*b*, is positioned following the third sliding section 22*c* and leads to fourth sliding section 22*d*. The fourth sliding section 22*d* leads to a final terminal transition 21, also configured as a pool, where riders may select one of two terminal sliding rides 23, 25 to complete travel through the complex 11.

Within the floating sections, riders may be subject to ride experiences including enclosed sections, such as enclosed section 27, as well as water curtains 29, which may also create alternating light effects. Flow-altering elements 40 as described herein may also be included.

Other embodiments of the complex 11 are possible with a vast variety of combinations of floating sections, sliding sections and transitions. Embodiments of the floating section as described herein may be useful in creating complexes that were not operable using conventional rides. For example, embodiments of the floating sections as described herein, may allow transitions (e.g. pools or platforms) to be connected into a complex without the need for a substantial change in elevation between the transitions, as would be the case if a sliding section were used to connect them, as longer sliding sections require a greater change in elevation to be operable than a floating section.

The inlet 28 and outlet 30 may be configured in a number of ways to achieve the steady-state body of water 31. In the embodiment illustrated in FIG. 2A, the inlet 28 includes a concave curvature 32 into the floating section 26 to permit water and ride vehicles 13 to slide or drop into the floating section 26. The outlet 30 includes a convex curvature 34 out of the flowing section 26 in turn allowing water and riders to flow and slide out of the floating section 26. The outlet 30, including convex curvature 34, functions as a type of weir causing a backup of water flow extending along the floating section 26 to the inlet 28.

Figure 2A:
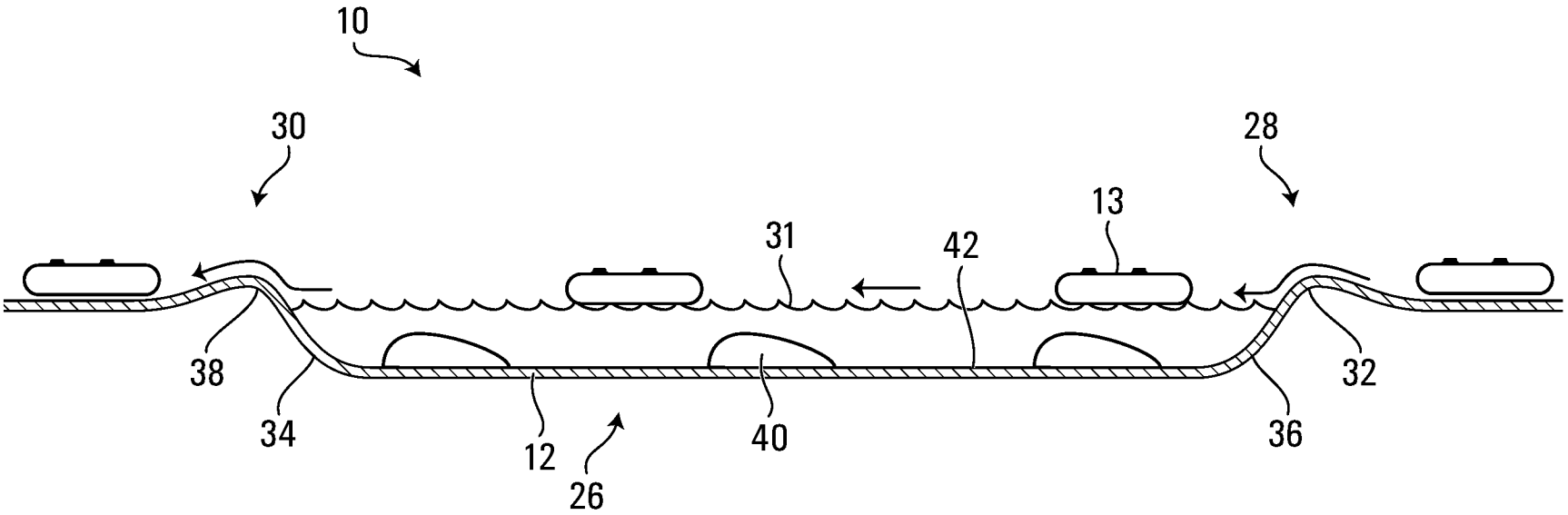
FIG. 2A is a schematic side view of a floating section according to one embodiment of the present disclosure.

In some embodiments, such as in the embodiment illustrated in FIG. 2A, both the inlet 28 and outlet 30 comprise a compound concave-convex curvature. Namely, the inlet 28 includes the concave curvature 32 followed by convex curvature 36 and the outlet includes the convex curvature 34 followed by concave curvature 38.

Other embodiments of the inlet and outlet are also possible. The inlet and outlet may not comprise any curvatures. Instead, the steady state body of water may result as a combination of the water flow (e.g. gallons per minute) being pumped through the flume. For example, as discussed below, in rides where the enter flume comprises a sliding section, the inlet and outlet may be configured in a conventional manner, with the steady-state body of water that permits floating resulting from a combination of water flow, flume depth, and/or flume geometry.

In some embodiments, the floating section 26 includes one or more flow-altering elements 40 attached to the flume 12. As shown, the flow-altering elements 40 may be configured as blocks, structures, artificial boulders or outcroppings, etc., extending from a surface 42 of the flume 12 in the floating section 26 that may take on a wide variety of shapes and geometries. In operation, they may be partially or fully submerged, depending on the size and positioning of the elements with respect to the flume and the depth of the water body 31.

The flow-altering elements 40 are configured to provide ride experiences to the riders travelling through the floating section 26. Moreover, the flow-altering elements 40 may be configured and arranged to define at least one alternate ride path different from an expected ride path defined by a geometry of the flume 12. For example, in a straight flume 12, without flow-altering elements present, the riders or ride vehicles may be expected to progress on a substantially straight, non-divergent ride path in a same direction as the direction of the flume. However, by configuration and arrangement of the flow altering elements the riders or ride vehicles may experience one or more alternate ride paths different from the expected ride path. For example, as discussed below, arrangement of flow-altering elements may result in a slalom ride path. Moreover, in some embodiments an initial expected ride path may diverge into two or more alternate ride paths defined by the flow-altering elements, for example in a wide flume permitting the alternate ride paths or, for example, at a fork in a flume where the floating section splits into two or more. The riders may have to actively choose which ride path to follow, for example by some action, such as paddling, or selection of ride paths through signalling.

Figure 2B:
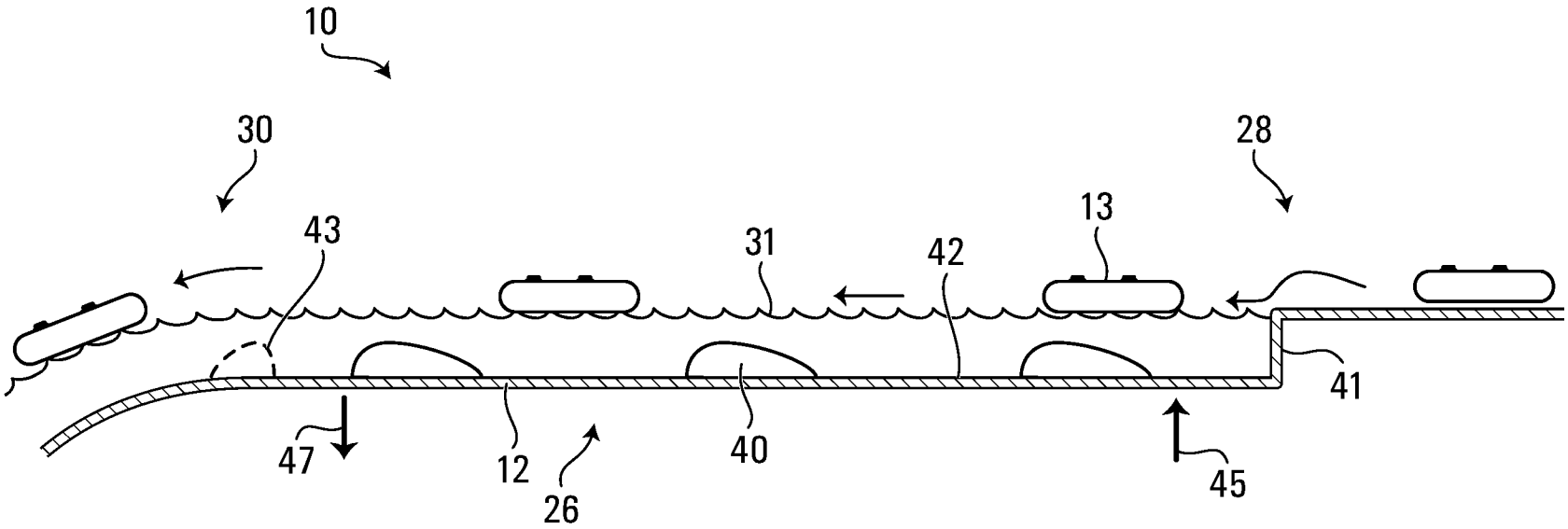
FIG. 2B is a schematic side view of a floating according to another embodiment of the present disclosure.
Figure 2C:
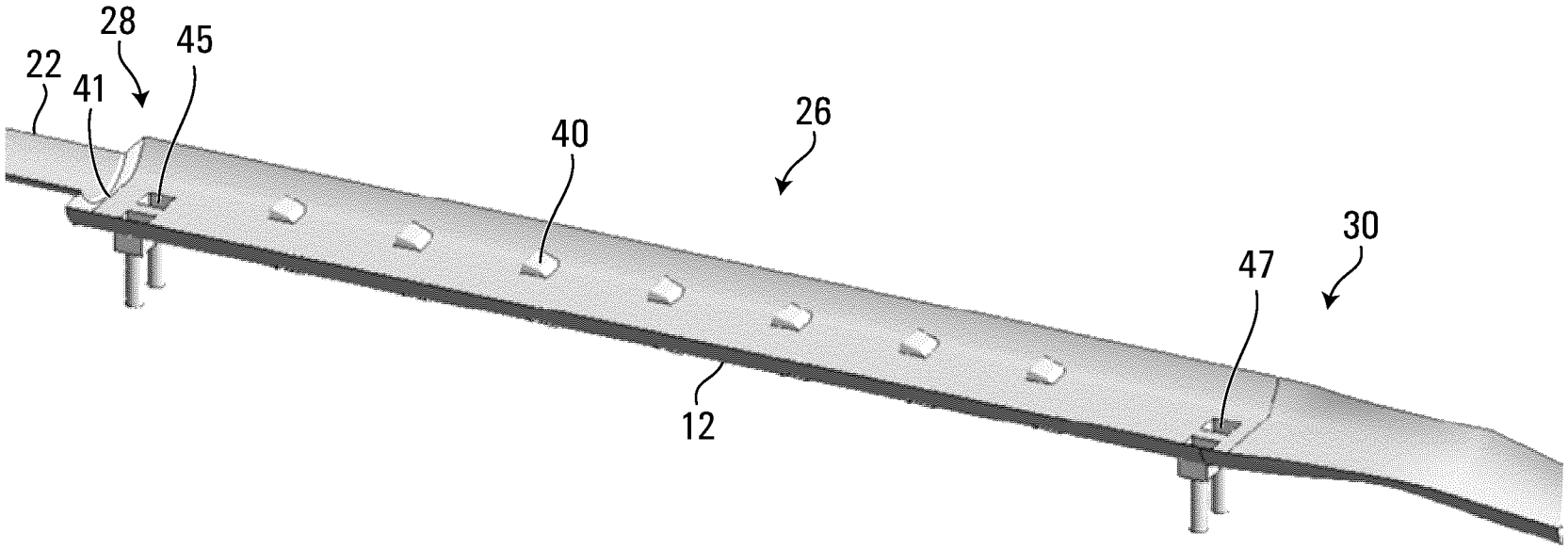
FIG. 2C is a perspective view of a floating section according to another embodiment of the present disclosure.

Another embodiment of a floating section is shown in FIGS. 2B and 2C. Specifically, inlet 28 and outlet 30 are configured differently than in the embodiment of FIG. 2A. In the embodiment of FIGS. 2B and 2C, the inlet forms a straight entry into the floating section 26, i.e. the inlet 28 transitions from a conventional flume where riders slide to the floating section 26 with a straight drop off 41 formed at a right angle as seen from the side. At the outlet 30, the relatively flat flume 12 of the floating section 26 continuously transitions to the remainder of the flume. In some cases, a raised, curved portion of the flume 12 is present and acts as a weir 43 (shown in dotted lines) to aid in controlling the level of the water body 31. Thus, in the embodiment of FIGS. 2B and 2C, the convex and/or concave curvatures 32, 34, 36, 38 are omitted or.

Water injectors 45 and water removal ports 47 are positioned within the floating section 26 adjacent the inlet 28 and outlet 30, respectively, to aid in maintain a desired level and flow of water in water body 31. This may aid ensuring a consistent speed of water flow between the inlet 28 and outlet 30, as well as a sufficient depth of water body 31 such that the presence of flow altering elements 40 does not result in "low spots" or possible undesirable flow effects such as eddies. Without the injection water flow adjacent to the inlet, entry into floating section 26 may not be consistent and, without the water removal, the water levels in the water body may build up, depending on the number, placement and configuration of the flow altering elements. The water injectors and water removal ports may be installed undermount or on sides of the floating section 26.

Water injection and/or water removal may be combined with other configurations of the inlet and outlet of the floating section to obtain other desired characteristics of the water body within the floating section. For example, water injection and/or water removal may be combined with the embodiment of the floating section illustrated and described in FIG. 2A.

In yet other embodiments, one or both of the inlet and outlet may be level or flush with the preceding and/or following sliding sections and water injection and removal is used to create a standing wave or surge of water in the floating section. More generally, the inlet and/our outlet may be configured to continuously transition from a circular profile of a conventional sliding flume to a different profile, such as a flat profile bottom surface, of the floating section and vice versa.

More generally, a first transition between a first sliding section and a floating section that immediately follows the first sliding section may be discontinuous, such as, for example, a step down or drop down. A second transition between the floating section and a second sliding section that immediately follows the floating section may be continuous, such as, for example, a flush, level or at grade transition. In some embodiments, the second transition incorporates a flume curvature that acts as a weir. The water injection and/or removal may be configured to aid in maintaining a desired flow and level of water of the water body in the floating section.

In some embodiments, the flow altering elements may also aid in maintaining a desired water level in the water body; for example, placement of flow altering elements that act as a partial or full weir adjacent the outlet.

In some embodiments, the flow altering elements are omitted from a floating section according to embodiments described in the present disclosure.

Some examples of flow-altering elements are shown in FIGS. 3A, 3B, 4A, 4B and 5, which are schematic views with arrows showing a possible flow pattern of water due to the flow-altering elements.

Figure 3A:
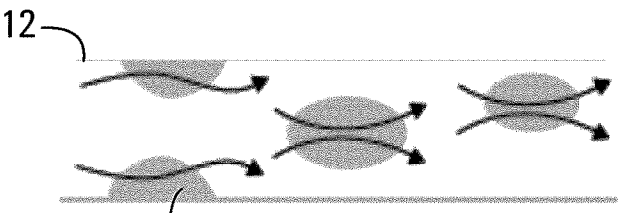
FIGS. 3A and 3B are partial schematic top and side views, respectively, of a portion of a floating section according to one embodiment of the present disclosure.
Figure 3B:
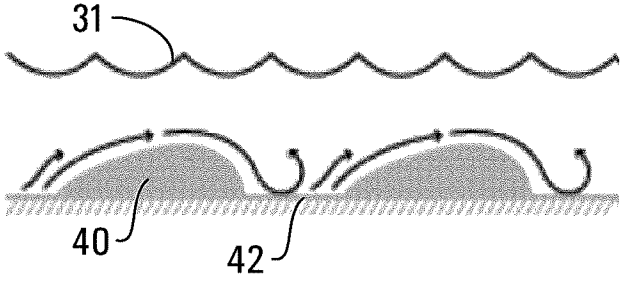

For example, as shown in FIGS. 3A and 3B, the flow-altering elements may be fully submerged and more smoothly rounded on a side facing the flow of water than on a back side, which has a smaller radius of curvature. This results in a possible flow of water causing eddies on the back side of the elements 40.

Figure 4A:
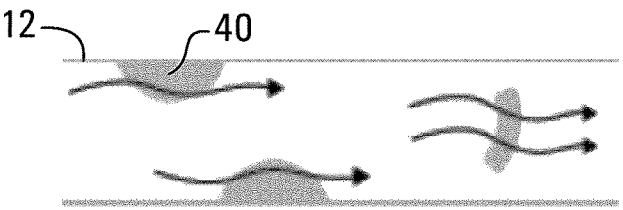
FIGS. 4A and 4B are partial schematic top and side views, respectively, of a portion of a floating section according to one embodiment of the present disclosure.
Figure 4B:
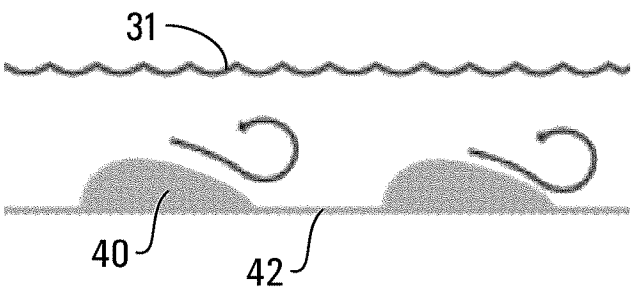

In a further example, as shown in FIGS. 4A and 4B, the flow-altering elements may be configured with a smaller radius of curvature facing the flow of water and with a smoother and more gradual decline on their back side. This results in yet other flow patterns.

Figure 5:
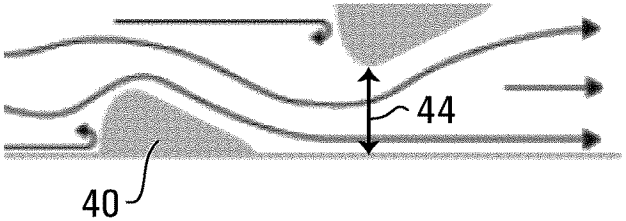
FIG. 5 is a partial schematic top view of a portion of a floating section according to one embodiment of the present disclosure.

In yet a further example, as shown in FIG. 5, the flow altering elements 40 extend out of the water, resulting in water that is obstructed or flows around the flow-altering elements 40.

Moreover, as shown in FIGS. 3A, 3B, 4A, 4B and 5, the flow-altering elements may be attached to a side of the flume 12 or be positioned stand-alone within the flume 12.

When fully submerged, for example, the flow-altering elements 40 may contact the underside of the ride vehicles 13 providing a tactile sensation to the riders seated in the vehicles 13. When extending out of the water, the flow-altering elements 40 may act as obstacles that the ride vehicles 13 passively circumnavigate, carried by the flow of water.

The flow-altering elements 40 may form a constriction 44 in a width of the flume 12, resulting in a faster flow through the constriction. The constriction may be between two flow-altering elements or between a flow-altering element and a side wall of the flume 12, as shown in FIG. 5.

Yet other configurations of the flow-altering elements 40 are also possible.

Further examples are shown in FIGS. 6A, 6B, 7A, 7B, 8A, 8B, 9A, 9B, 10A and 10B, which are perspective and top views, respectively, of a portion of one embodiment of a flume showing various embodiments of flow-altering elements protruding from the flume.

Figure 6A:
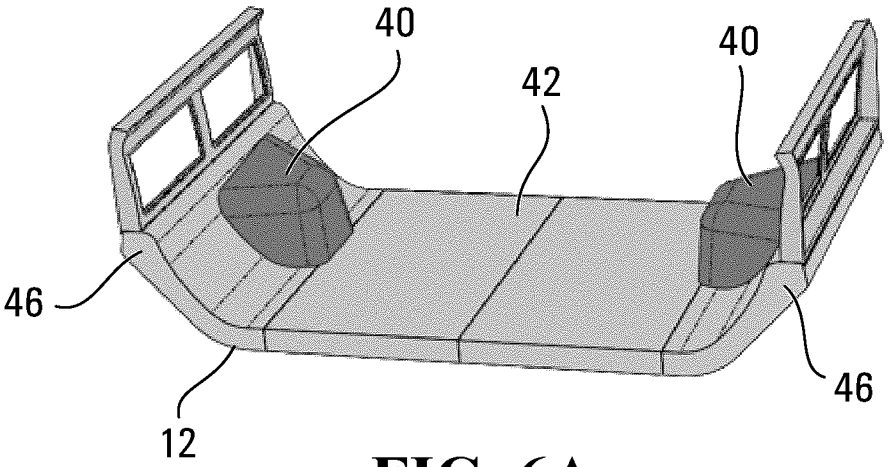
FIGS. 6A and 6B show schematic perspective and top views, respectively, of a portion of a floating section according to one embodiment of the present disclosure.
Figure 6B:
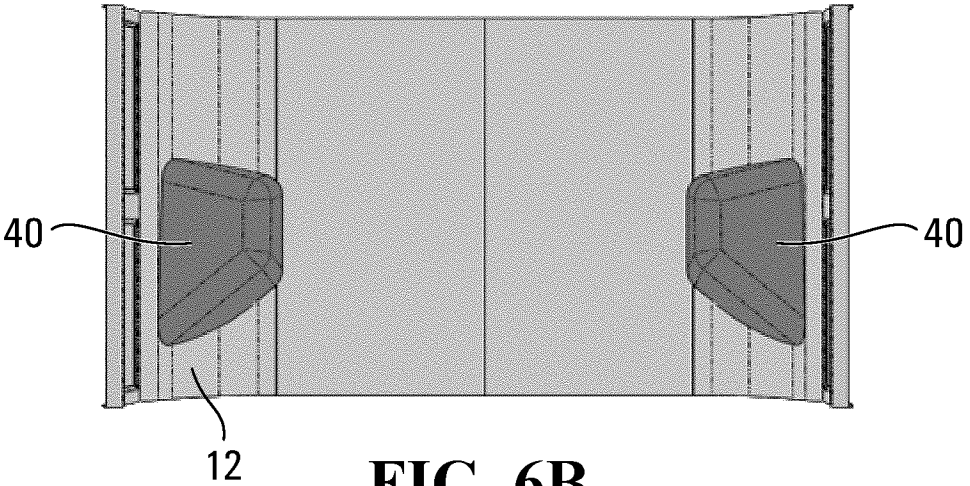

As shown in FIGS. 6A and 6B, some of the flow-altering elements 40 may comprise block-like protrusions with rounded edges extending from sides 46 of the flume 12, forming a constriction or narrower throat section. Water flowing in the constriction is accelerated through a center of the flume 12. Depending on the sizing of the flow-altering elements they may be fully or partially submerged.

Figure 7A:
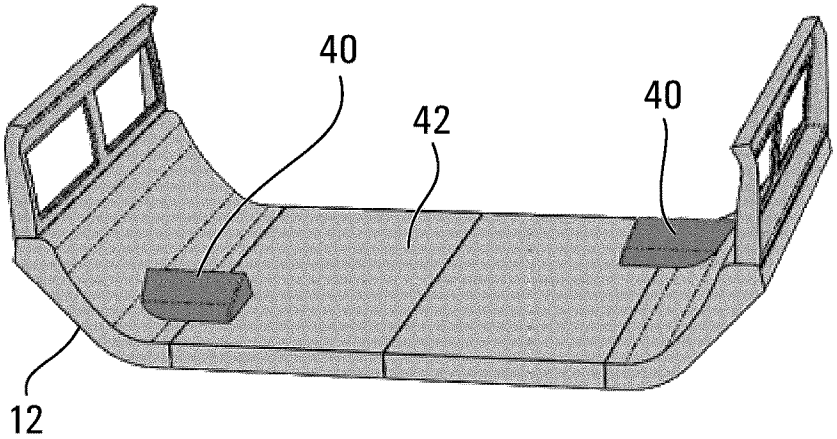
FIGS. 7A and 7B show schematic perspective and top views, respectively, of a portion of a floating section according to one embodiment of the present disclosure.
Figure 7B:
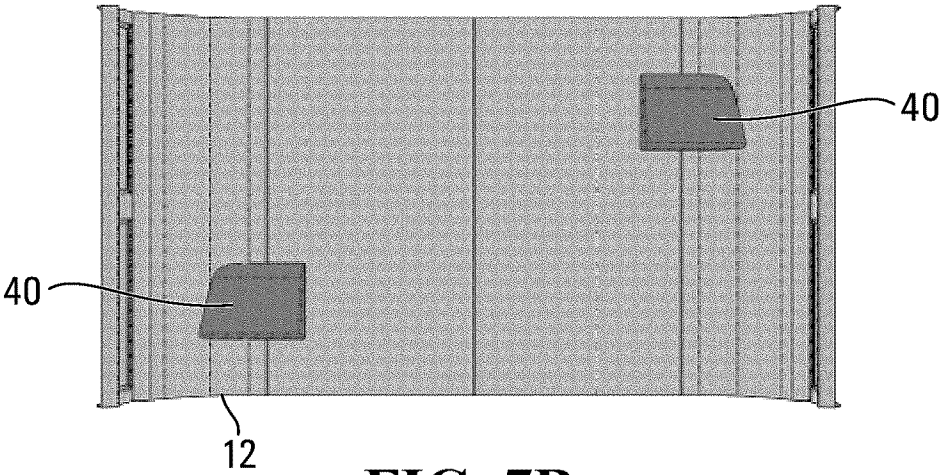
Figure 8A:
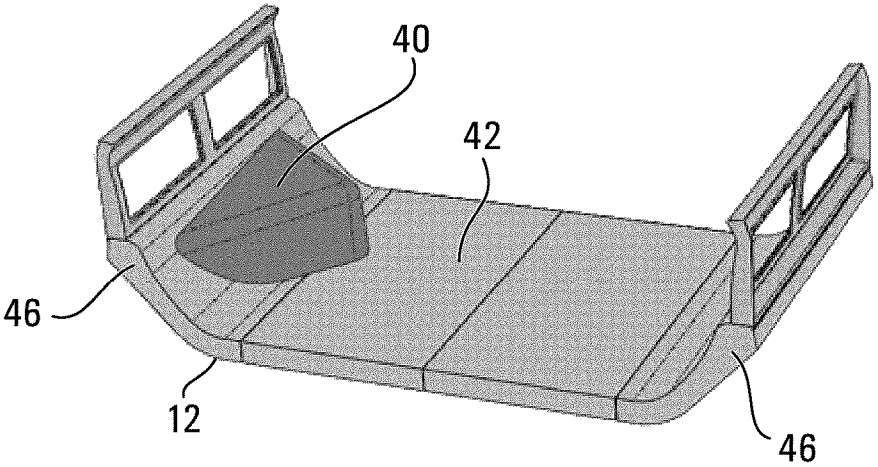
FIGS. 8A and 8B show schematic perspective and top views, respectively, of a portion of a floating section according to one embodiment of the present disclosure.
Figure 8B:
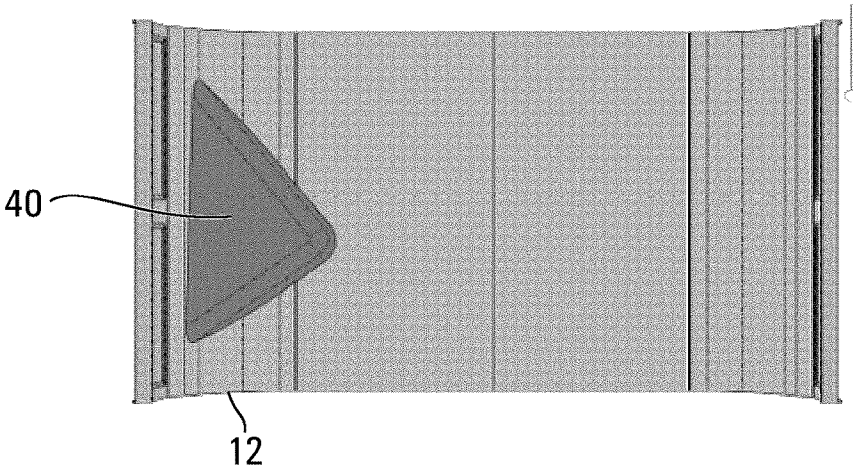
Figure 9A:
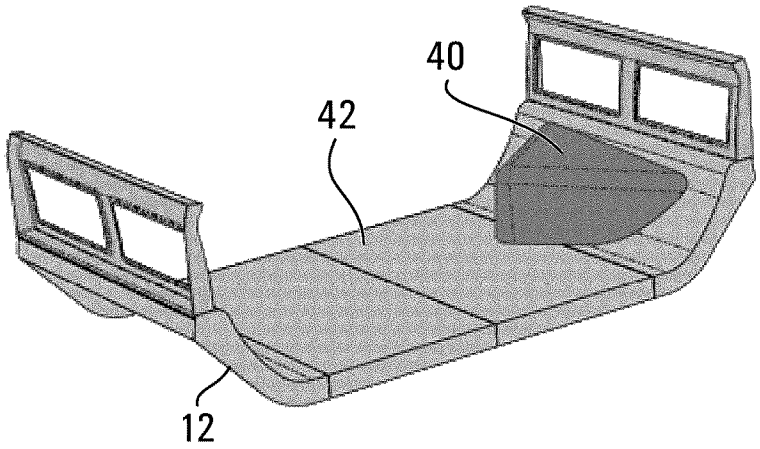
FIGS. 9A and 9B show schematic perspective and top views, respectively, of a portion of a floating section according to one embodiment of the present disclosure.
Figure 9B:
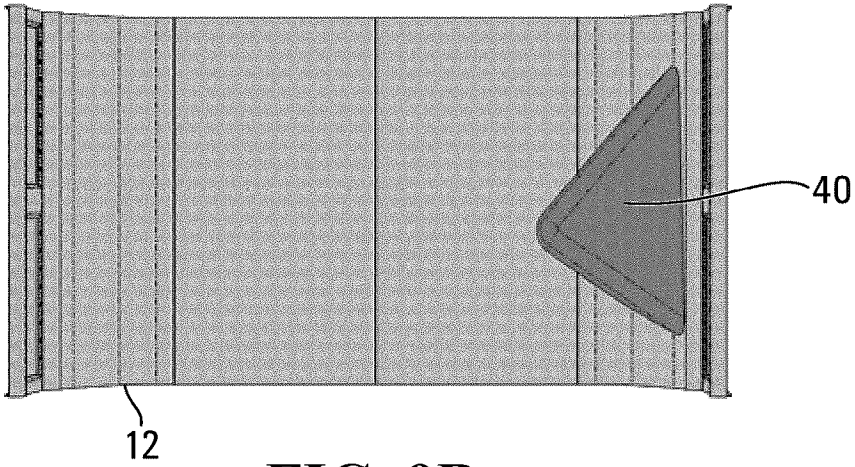

As shown in FIGS. 7A and 7B, some of the flow-altering elements may comprise ramp-like protrusions positioned partially or fully on the surface 42 of the flume 12. Such protrusions may be fully submerged and create a white water or ripple effect.

As shown in FIGS. 8A, 8B, 9A, and 9B, some of the flow-altering elements may comprise triangular, block-like protrusions with rounded edges jutting from one or both sides 46 of the flume 12. Positioned successively either on the same side or alternating sides of the flume 12, such flow-altering elements may define an alternative ride path different than the ride path expected from and defined by the geometry of the flume 12; for example, a slalom ride path.

Figure 10A:
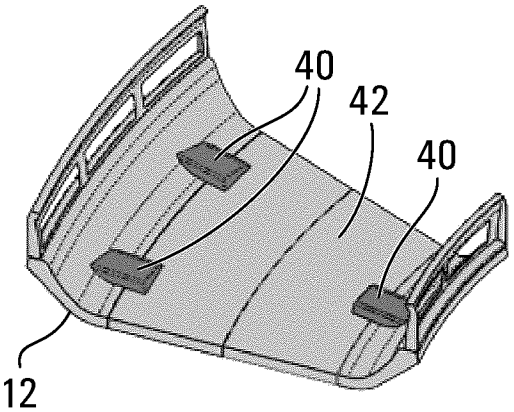
FIGS. 10A and 10B show schematic perspective and top views, respectively, of a portion of a floating section according to one embodiment of the present disclosure.
Figure 10B:
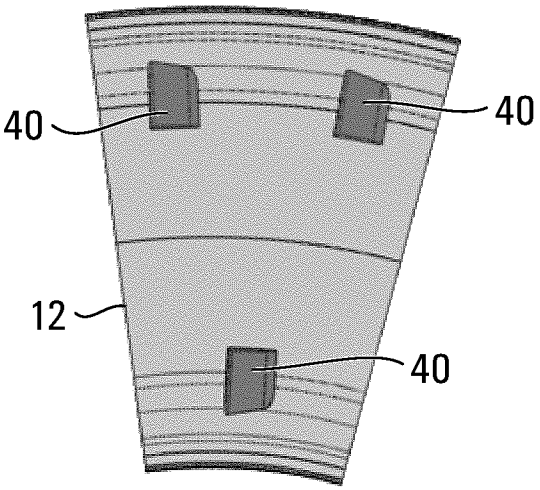

As shown, in FIGS. 10A and 10B, curved portions of the flume 12 may also include flow-altering elements 40, one example of which is shown.

More generally, the flow-altering elements 40 may be configured differently than shown. They may be configured to produce white-water, ripples, whirlpools and other flow effects that act on the ride vehicles 13. Additional flow altering elements may include wave generation technology, wherein the flow altering elements and/or wave generation can be triggered to create a water effect in the floating channel. The water effect may be triggered by a series of sensors that detect the presence of riders or a ride vehicle in the ride, connected back to a control system that then initiates the appropriate wave or water effects at the appropriate time.

The flow-altering elements 40 may be detachable from the flume 12. This may aid in initial set up and configuration of the ride, where repositioning of the flow-altering elements 40 may be desirable after initial test runs to ensure proper functioning of the ride. The flow-altering elements may also be movably attached to the flume, which may permit the adjustment of their precise position within a predefined range. In some embodiments, removably or movably attached flow-altering elements may also allow for a modular design, where the ride experience of a floating section 26 could be varied by: altering the position of the flowing alter elements 40, changing their configuration (e.g. size, geometry, surface texture, density, aesthetics, etc.), or adding or omitting one or more of the flow-altering elements 40.

The flow altering elements may be made of any suitable material, including a fiber composite material, mouldable concrete, plastic, etc. In yet other embodiments, an inflatable bladder within the flow-altering elements may allow for an increase of volume by pumping air or another fluid into the flow-altering elements.

The flow-altering elements may comprise features, such as surface features, that further aid in creating tactile or flow-altering sensations for riders. For example, the flow-altering may have a textured surface and/or one or more protrusions and recesses on external surfaces.

Various systems may be used to attach the flow-altering elements 40 to the flume 12. These may include:

- Forming the flow-altering elements as part of the flume 12
- mechanical fastening, for example using bolts driven into the flow-altering elements from underneath to connect to the flume 12, with sealant and gaskets to prevent leaks,
- adhesives,
- brackets or other securing structures, such as an intermediate rail that permits repositioning along one or more axes,
- tethering to the flume, the flow-altering elements being maintained in position by their own weight,
- tethering to the flume, permitting the flow-altering elements to float,
- magnetic couplings between magnetic components in the flow-altering elements 40 and in or beneath the flume 12, and
- tongue-and-groove or other positive locking configurations.

Referring to FIGS. 11 to 14, some additional possible configurations for attaching the flow-altering elements are shown.

Figure 11:
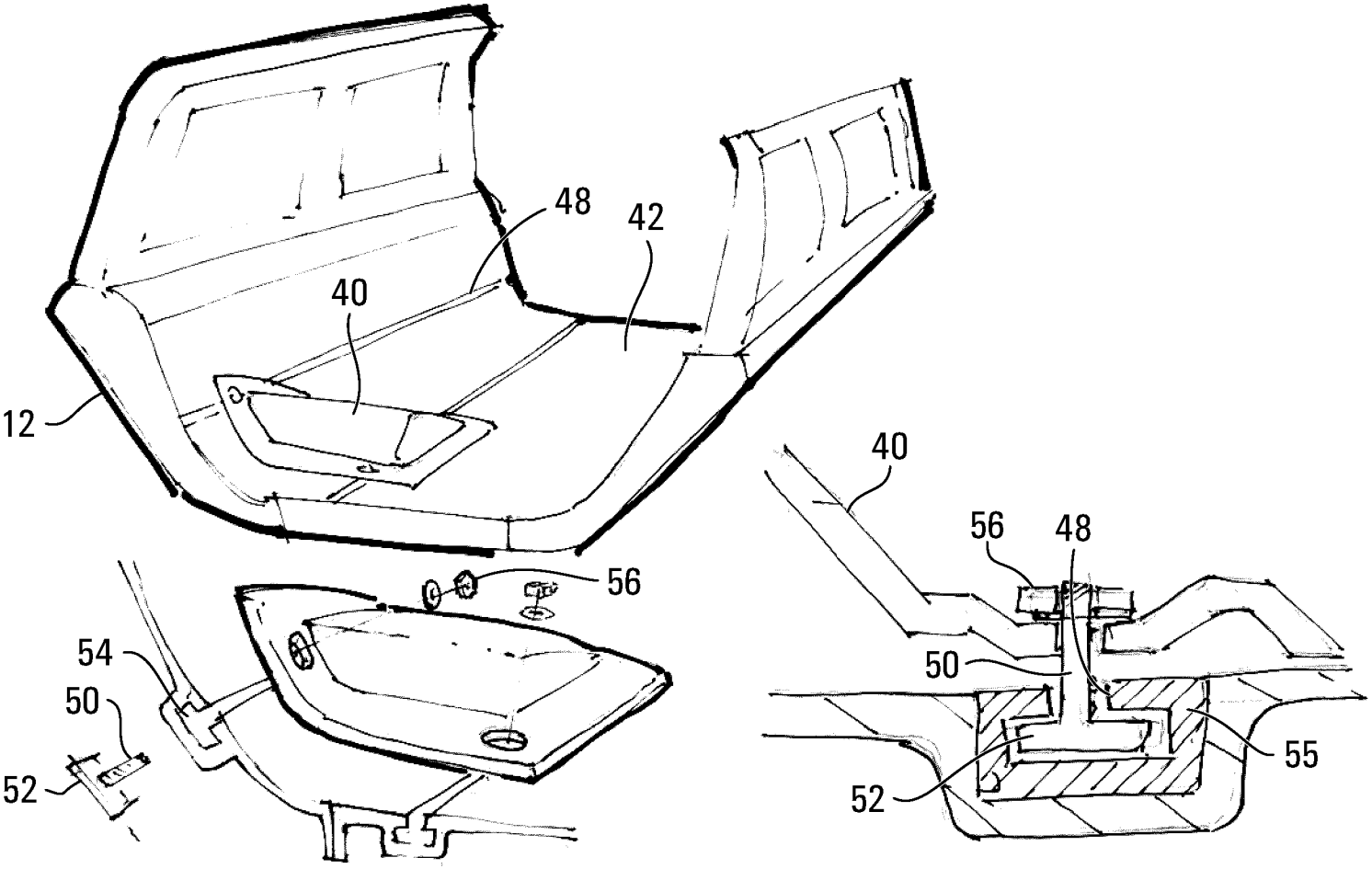
FIG. 11 shows one embodiment of an attachment mechanism for embodiments of flow-altering elements according to the present disclosure.

Referring to FIG. 11, the flow-altering elements 40 may be bolted with a recessed bolt/nut arranged to one or more grooves, slots or channels 48 in the flume 12. A bolt 50 extends from a bolt plate 52 that is slidably mounted in a wider portion 54 of the slot 48, with the bolt 50 protruding, such that the bolt is only permitted to slide. The slot 48 may be comprised of a bushing material 55 forming a channel and inserted into the flume 12, or it may be integral to the flume 12. The flow-altering element 40 is then fixed in place by tightening each nut 56 to each bolt 50. Loosening the nuts 56 and sliding the bolts to new positioned within the slot 48 may allow for repositioning of the flow-altering elements 40 within the flume 12.

Figure 12:
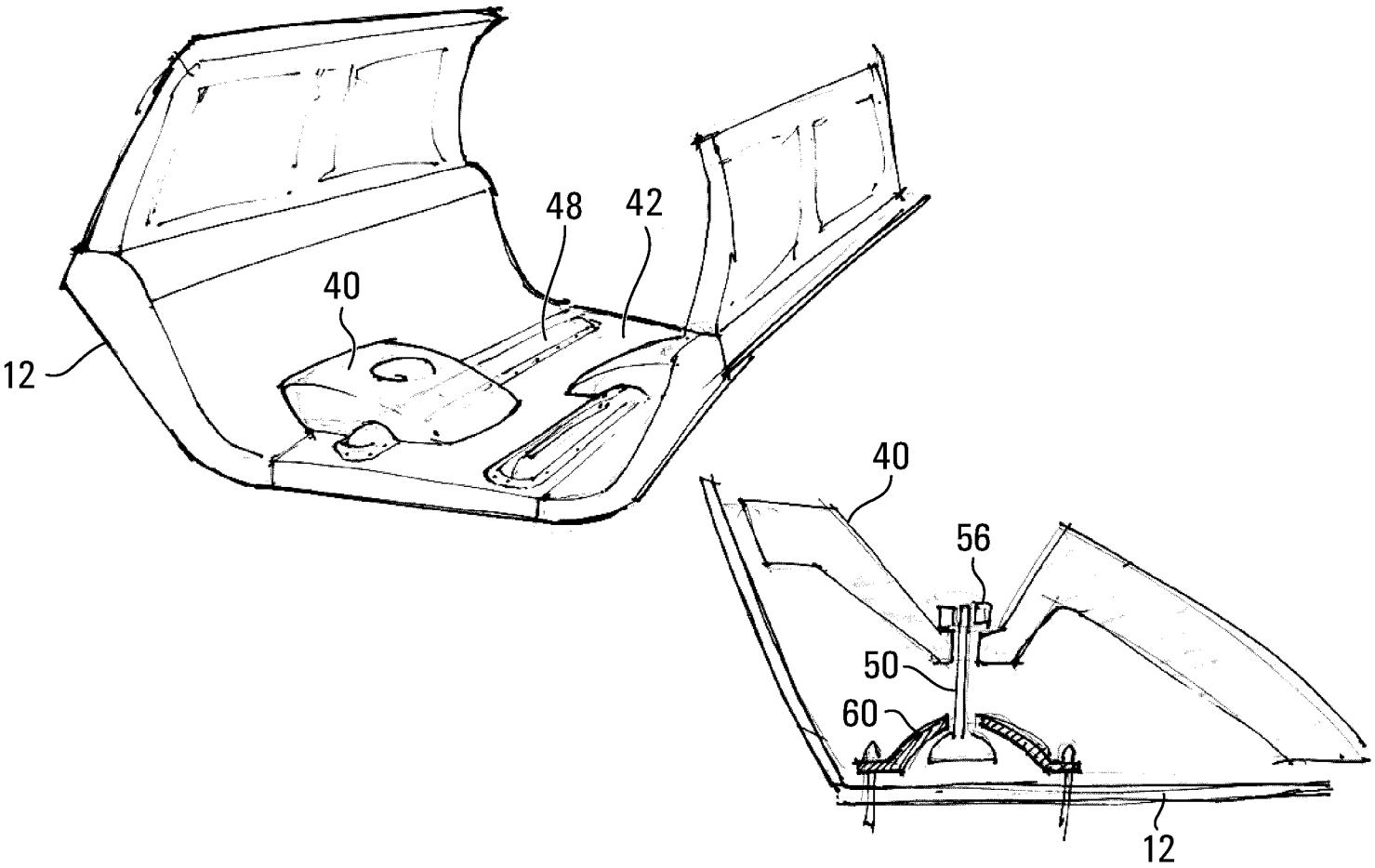
FIG. 12 shows one embodiment of an attachment mechanism for embodiments of flow-altering elements according to the present disclosure.

Referring to FIG. 12, the flow-altering element 40 may be movably fixed by a recessed bolt 50 in a raised channel 58 formed by a domed or capped bracket 60 mounted to the flume 12. By loosening nut 56, the flow altering element 40 may be slid and repositioned along a length of the channel 48.

Figure 13:
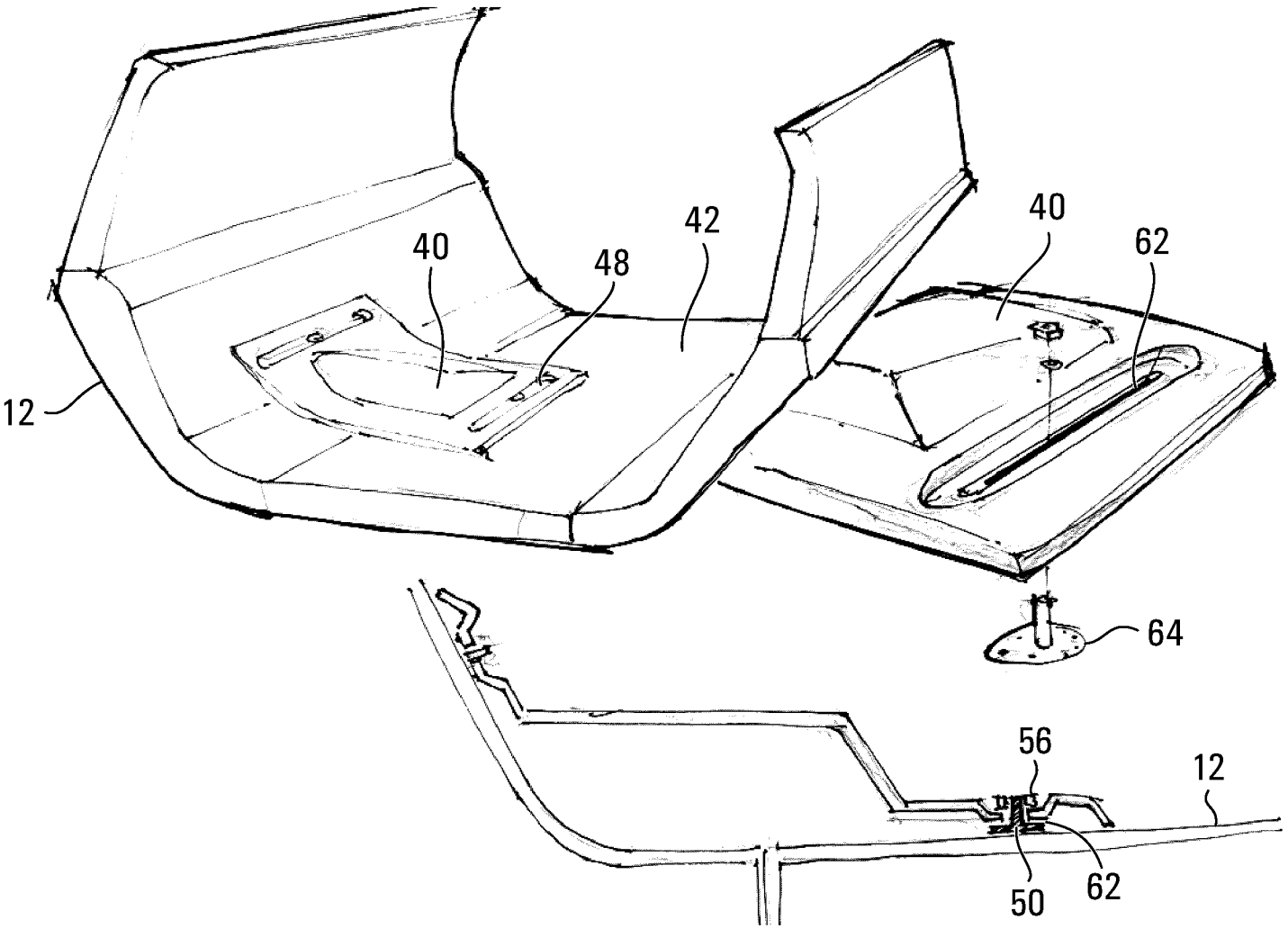
FIG. 13 shows one embodiment of an attachment mechanism for embodiments of flow-altering elements according to the present disclosure.

Referring to FIG. 13, the flow-altering element 40 may be movably fixed by a recessed bolt or bolts 50 passing through a slot, groove or channel 62 in the flow-altering element 40. The bolt 50 screws is integral with or screwed into pedestal 64 attached to the flume 12. Loosening nuts 56 and sliding the flow-altering element 40 with respect to the pedestal 64 may allow for repositioning of the flow-altering elements 40 within the flume 12.

Figure 14:
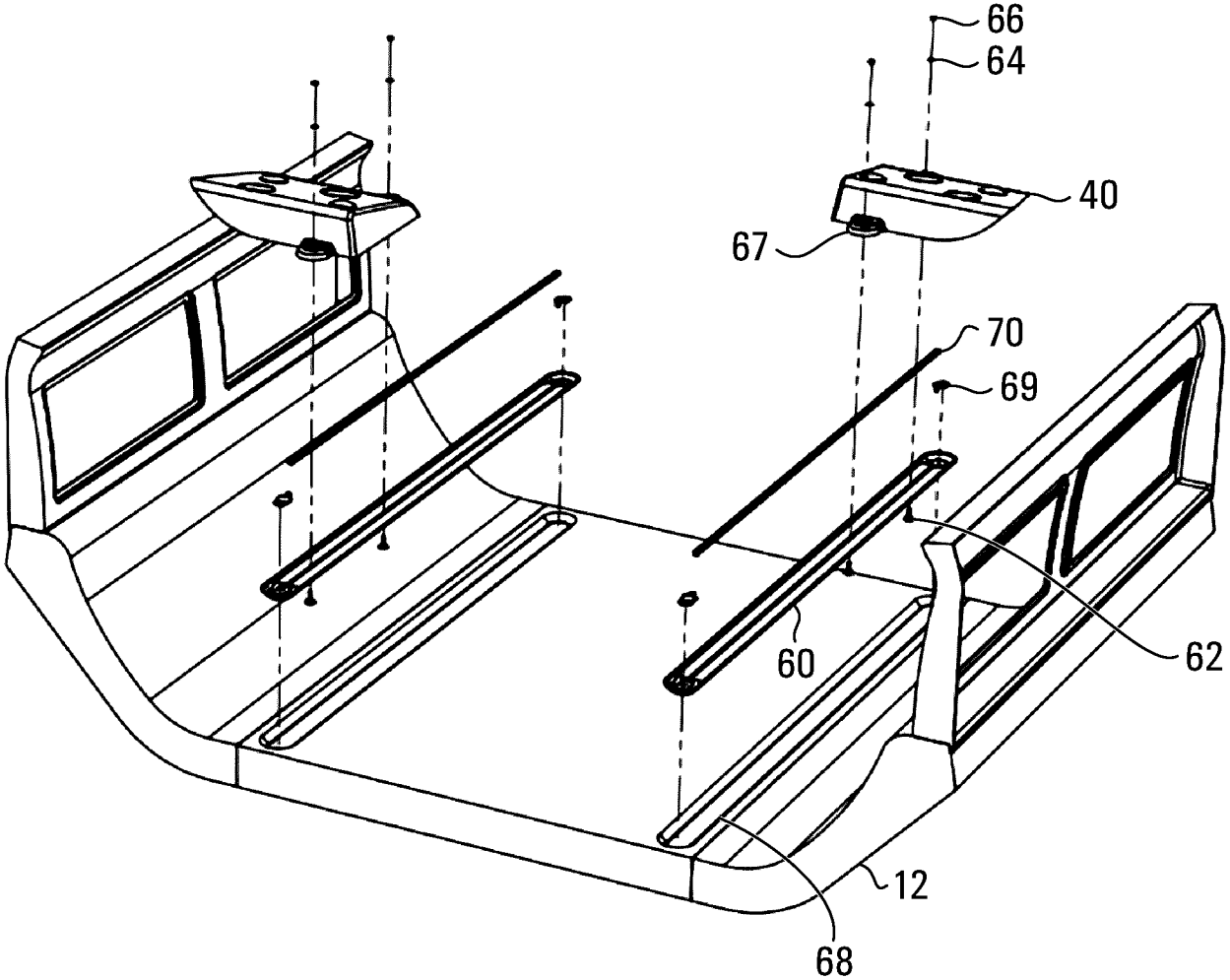
FIG. 14 shows an exploded view of one embodiment of an attachment mechanism for embodiments of flow-altering elements according to the present disclosure.

Referring to FIG. 14, the flow-altering element 40 may be movably fixed to the flume 12 via a rail 60, such as a fibre reinforced plastic or metal rail, a T-Nut 62 and a corresponding washer 64 and nut 66, that are threaded through holed flanges 67 on either side of the flow altering element 40. The rail 60 is embedded within a groove or channel 68 within the flume 12, fixed by a rail clip or other fastener 69 and covered with a slot cover 70.

Yet other configurations are also possible. As noted above, in some embodiments, there may be multiple channels for moving the flow-altering elements in multiple directions along multiple axes, including closer or further away from the flume surface.

Moreover, in some embodiments, the flow-altering elements may be motorized or otherwise able to be dynamically repositioned, for example with a motorized pulley for sliding the element along a track. This may permit dynamic alteration or repositioning during operation of the ride, including in response to activation signals from riders in the ride.

Similarly, in some configurations, the shape, size and/or geometry of the elements may be dynamically altered during operation of the ride using pumps, pulleys, and other mechanical systems.

Furthermore, the flow-altering elements could be triggered to be initiated by a control system that is connected to a series of sensors that detect the presence of riders or ride vehicles throughout the ride, approaching the floating section and/or in other positions.

The flume 12 may be comprised of fibre-reinforced plastic (FRP) of the type commonly used in the water ride industry, particularly for water slides. In some embodiments, using FRP may allow for a modular design of the flow altering elements 40 since manufacturing of the flume segments, including the segments used for the floating sections, may allow for the introduction of one or more of the above-noted attachment systems for the flow altering elements that would not be possible with, for example, a concrete channel as used for conventional "river"-style rides. Such manufacturing methods include a hand-layup open mould lamination process.

While FIG. 1 shows a ride comprising both sliding and floating sections, in some embodiments according to the present disclosure, a water ride comprises a single floating section, or multiple, fluidly connected floating sections for an entire length of the flume from the initial location to the terminal location. In such embodiments, the inlet and outlet of each section or, if there is only a single section, for the entire ride may include the above-noted curvatures to allow for a steady-state body of water in which the ride vehicles float. In such a ride, a single floating section may include multiple zones or regions with different flow-altering elements to create differing ride experiences in the travel path of the rider. Similarly, in embodiments with multiple, successive or non-successive floating sections, each section may comprise a different arrangement or configuration of flow-altering elements.

Example of configurations for a flume section with a floating section according to the present disclosure are as follows. These are illustrative examples only and not to be limiting of the possible embodiments according to the present disclosure:

In a ride where larger, multi-person rafts are used:
Flume Width: 11.5 ft-13 ft (3.5 m-4 m)
Flow Rate from Ride: 6500 USGPM-13 000 USGPM
Flow Rate From injectors: 2000-6500 USGPM
Velocity in Channel: 3 fts/-6.5 ft/s (1-2 m/s)
Depth of water in channel: 0.8 ft-1.15 ft (0.25-0.35 m)
In a ride where smaller tube-like vehicles are used:
Flume Width: 8 ft-10 ft (2.5 m-3 m)
Flow Rate from Ride: 3000 USGPM-6000 USGPM
Flow Rate from Injector: 1000 USGPM-3000 USGPM
Velocity in Channel: 3 fts/-6.5 ft/s (1-2 m/s)
Depth of water in channel: 0.8 ft-1.15 ft (0.25-0.35 m)

It will also be understood that while the illustrated embodiment was described as having ride vehicles slide and float therein, embodiments within the present disclosure include riders floating without vehicles, for example alone or using personal flotation devices, such as inner tubes or flotation vests.

Numerous specific details have been set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a nonexclusive inclusion. For example, a composition, a process, method, article, or apparatus that comprises a list of elements is not necessarily limited to only those elements but may include other elements not expressly listed or inherently present therein.

As used herein the terms "approximately," "about," "substantially" and variations thereof are intended to include not only the exact value qualified by the term, but to also include some slight deviations therefrom, such as deviations caused by measuring error, manufacturing tolerances, wear and tear on components or structures, stress exerted on structures, and combinations thereof, for example.

Use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment. Moreover, it will be understood that features of one embodiment may be combined with features of other embodiments, even if not expressly recited or described as a combination.

The invention claimed is:

1. A water ride comprising a flume adapted to have riders or ride vehicles travel from an initial location at a first elevation to a terminal location at a second elevation lower than the first elevation, wherein water flows from the initial location to the terminal location, the flume comprising:

at least one sliding section wherein the riders or ride vehicles slide on a sliding surface of the flume; and at least one floating section wherein the riders or ride vehicles float on a surface of the water in the flume, the floating section being fluidly connected to the first sliding section and comprising a plurality of flow-altering elements attached to and protruding from the flume, wherein the first floating section includes an inlet, wherein the inlet comprises a step, drop down, or concave curvature into the first floating section.

2. The water ride of claim 1, wherein the first floating section includes an outlet, wherein the outlet comprises a substantially flush transition between the first floating section and a subsequent sliding section.

3. The water ride of claim 1, further comprising a second sliding section, wherein the first floating section is positioned between the first and second sliding sections and is fluidly connected to the second sliding section.

4. The water ride of claim 1, wherein one or more of the flow-altering elements are removably and/or movably attached to the flume.

5. The water ride of claim 1, wherein, in operation, one or more of the flow-altering elements are at least partially submerged in the water.

6. The water ride of claim 5, wherein, in operation, one or more of the flow-altering elements are entirely submerged in the water.

7. The water ride of claim 1, wherein one or more of the flow-altering elements form a constriction in the flume.

8. The water ride of claim 1, wherein the first floating section includes an outlet, wherein the outlet comprises a concave, convex, or compound concave-convex curvature out of the first floating section.

9. A flume section for a water ride, the flume section comprising:

an inlet to permit riders or ride vehicles to enter the flume section, wherein, in operation, the flume section provides a flowing body of water for the riders or ride vehicles to float on a surface of the water, wherein a geometry of the flume section defines an expected ride path for the riders or ride vehicles and the one or more flow-altering elements are configured and arranged to define at least one alternate ride path for the riders or ride vehicles that differs from the expected ride path;

an outlet to permit riders or ride vehicles to exit the flume section; and a plurality of flow-altering elements operable within the flume section.

10. The flume section of claim 9, wherein the flow-altering elements are attached to and protruding from the flume.

11. The flume section of claim 10, wherein one or more of the flow-altering elements are removably attached to the flume section.

12. The flume section of claim 10, wherein, in operation, one or more of the flow-altering elements are at least partially submerged in the water.

13. The flume section of claim 10, wherein, in operation, one or more of the flow-altering elements are entirely submerged in the water.

14. The flume section of claim 10, wherein one or more of the flow-altering elements form a constriction in the flume section.

15. The flume section of claim 10, wherein one or more flow-altering elements are movably attached to the flume section.

16. The flume section of claim 9, wherein the one or more flow-altering elements are configured and arranged to provide two or more alternate ride paths.

17. The flume section of claim 9, wherein the flow-altering elements comprise a wave generator.

18. The flume section of claim 9, wherein some or all of the one or more flow-altering elements are triggered to create a water effect by a control system configured to detect a presence of riders or ride vehicles at one or more positions within the water ride.

19. A water ride comprising a flume adapted to have riders or ride vehicles travel from an initial location at a first elevation to a terminal location at a second elevation lower than the first elevation, wherein water flows from the initial location to the terminal location, the flume comprising:

a first sliding section of the flume wherein the riders or ride vehicles slide on a sliding surface of the first sliding section;

a floating section wherein the riders or ride vehicles float on a surface of the water in the flume, the floating section immediately following the first sliding section and being fluidly connected to the first sliding section; and a second sliding section of the flume wherein the riders or ride vehicles slide on a sliding surface of the second sliding section, the second sliding section immediately following the floating section and being fluidly connected to the floating section, wherein the first sliding section transitions to the floating section at a first transition that comprises a step, drop down, or concave curvature, wherein the floating section transitions to the second sliding section at a second transition, and wherein water is injected into the floating section and removed from the floating section to maintain a desired water level in the floating section.

20. The water ride of claim 19, wherein water is injected into the floating section adjacent the first transition.

21. The water ride of claim 19, wherein water is removed adjacent the second transition.

22. The water ride of claim 19, wherein the second transition comprises a level transition between the floating section and the second sliding section.

23. The water ride of claim 19, wherein the second transition comprises a curved flume portion that acts as a weir to raise the water level in the floating section immediately upstream of the weir.

24. The water ride of claim 19, wherein the water injection and/or water removal are configured so that a speed of the riders or ride vehicles in the floating section is less than the speed of the riders or ride vehicles in both the first and second sliding sections.

25. The water ride of claim 1, wherein the inlet comprises a compound concave-convex curvature.

26. The water ride of claim 19, wherein the first transition and/or second transition comprises a compound concave-convex curvature.

27. The water ride of claim 1, wherein water is removed from the first floating section and injected into a further floating section.

* * * * *